US006453853B1

(12) United States Patent
Hawkins et al.

(10) Patent No.: US 6,453,853 B1
(45) Date of Patent: Sep. 24, 2002

(54) METHOD OF CONTROLLING A VARIABLE SPEED FAN

(75) Inventors: Jeffery Scott Hawkins, Farmington Hills, MI (US); Charles C. Blake, Commerce, MI (US); Ronald William Mikulik, Orangeville (CA); Steve Miller Weisman, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 56 days.

(21) Appl. No.: 09/729,610

(22) Filed: Dec. 4, 2000

(51) Int. Cl.[7] ..... F01P 7/02
(52) U.S. Cl. ..... 123/41.12; 123/41.49
(58) Field of Search ..... 123/41.12, 41.11, 123/41.49

(56) References Cited

U.S. PATENT DOCUMENTS 3,942,486 A * 3/1976 Kirchner ..... 123/41.12
4,062,329 A * 12/1977 Rio ..... 123/41.12
4,774,910 A * 10/1988 Aihara et al. ..... 123/41.12
4,874,072 A 10/1989 Mohan et al.
4,913,102 A * 4/1990 Ohmura et al. ..... 123/41.12
5,133,302 A 7/1992 Yamada et al.
5,224,446 A * 7/1993 Okita et al. ..... 123/41.12
5,483,927 A * 1/1996 Letang et al. ..... 123/41.12
5,531,190 A * 7/1996 Mork ..... 123/41.12
5,667,045 A * 9/1997 Cummings, III ..... 123/41.12
5,937,979 A 8/1999 Cummings
5,947,247 A 9/1999 Cummings, III
6,273,034 B1 * 8/2001 Hawkins et al. ..... 123/41.11
6,328,000 B1 * 12/2001 Hawkins et al. ..... 123/41.12

* cited by examiner

*Primary Examiner*—Willis R. Wolfe
*Assistant Examiner*—Jason Benton
(74) *Attorney, Agent, or Firm*—Brooks & Kushman P.C.

(57) ABSTRACT

Various control strategies and techniques for controlling a variable speed fan in an internal combustion engine are provided. The various control techniques improve fuel economy by operating the fan at a speed sufficient to cool the engine, while avoiding unnecessarily higher speeds that result in poor fuel economy. Further, the fan may be completely disabled at cold start up to avoid over cooling, particularly in an engine using a charge air cooling system.

30 Claims, 5 Drawing Sheets

METHOD OF CONTROLLING A VARIABLE SPEED FAN

TECHNICAL FIELD

The present invention relates to a method of controlling an internal combustion engine including a variable speed fan.

BACKGROUND ART

In the control of heavy duty internal combustion engines, the conventional practice utilizes electronic control units having volatile and non-volatile memory, input and output driver circuitry, and a processor that executes instructions to control the engine and its various systems and sub-systems. A particular electronic control unit communicates with numerous sensors, actuators, and other electronic control units to control various functions, which may include various aspects of field delivery, transmission control, and many others. When the engine includes a variable speed fan, the electronic control unit operates the fan in accordance with received fan request signals. Typically, although variable speed fans have been used with internal combustion engines, the control schemes utilized to control the variable speed fans have been simple and quite conservative to reduce the possibility of accidental overheating and engine component failure.

However, the heavy duty engine business is extremely competitive. Increased demands are being placed on engine manufacturers to design and build engines that provide better engine performance, improved reliability, and greater durability while meeting more stringent emission and noise requirements. Along with all of these, perhaps the greatest customer demand is to provide engines that are more fuel efficient. Demands for fuel efficiency are becoming so great, that all engine driven systems in the vehicle are being scrutinized in attempts to reduce power consumption when possible.

For the foregoing reasons, there is a need for an improved method of controlling an internal combustion engine including a variable speed fan in which the variable speed fan is aggressively controlled to improve vehicle fuel efficiency.

DISCLOSURE OF INVENTION

It is, therefore, an object of the present invention to provide a method controlling an internal combustion engine including a variable speed fan in which one or more engine conditions are sensed, and the applied fan request signal is based in part on the measured engine conditions to operate the fan at speeds necessary for cooling, but not excessive, such that overall fuel efficiency is improved.

In carrying out the above object and other objects and features of the present invention, a method of controlling an internal combustion engine is provided. The engine includes a variable speed fan; the variable speed fan is driven in response to an applied fan request signal having a value between a predetermined maximum fan request value and a predetermined minimum fan request value. The engine is operable over an engine speed range between an idle speed and a full speed. The method comprises establishing a fan speed limit, determining an initial fan request signal, and determining the applied fan request signal by limiting the initial fan request signal. The fan speed limit is a maximum allowable fan speed during operation of the engine at all engine speeds in the engine speed range. The initial fan request signal is based on engine operating conditions and has a value between the minimum fan request value and the maximum fan request value.

The maximum fan request value is sufficiently large to cause the fan speed to approach the fan speed limit as the engine speed approaches an intermediate speed between the idle speed and the full speed. The applied fan request signal is determined by limiting the initial fan request signal based on engine speed such that the fan speed approaches the fan speed limit as the engine speed approaches the intermediate speed when the initial fan request signal value is the maximum fan request value. While the initial fan request signal value is the maximum fan request value, the fan speed remains below the fan speed limit as the engine speed approaches the full speed, allowing higher fan speeds at lower engine speeds while avoiding fan overspeed at higher engine speeds.

In a preferred embodiment, the method further comprises monitoring the fan speed, and limiting engine speed, as needed, to prevent the applied fan request signal from causing the fan speed to exceed the fan speed limit. Preferably, determining the initial fan request signal further comprises determining a plurality of preliminary initial fan request signals. Each request signal has a value based on at least one engine condition. The initial fan request signal is determined as the preliminary fan request signal having the greatest value. The above method is suitable for a hydraulically driven variable speed fan wherein hydraulic oil is pumped by a pump to drive a hydraulic fan motor.

Further, in carrying out the invention, a method of controlling an internal combustion engine is provided. The engine includes a hydraulically driven variable speed fan wherein hydraulic oil is pumped by a pump to drive a hydraulic fan motor. The variable speed fan is driven in response to an applied fan request signal having a value between a maximum fan request value and a minimum fan request value. The engine is operable over an engine speed range between an idle speed and a full speed. The method comprises establishing a hydraulic oil threshold temperature, monitoring a temperature of the hydraulic oil, determining an initial fan request signal, and determining the applied fan request signal. The initial fan request signal has a value between the minimum fan request value and the maximum fan request value. The applied fan request signal is determined as the initial fan request signal when the oil temperature falls below the oil threshold temperature. The applied fan request signal is determined as a modified fan request signal having a value greater than the initial fan request signal value to compensate for losses due to increased hydraulic oil temperature when the oil temperature exceeds the oil threshold temperature.

In a preferred embodiment, determining the applied fan request signal further comprises determining a multiplier, and determining the applied fan request signal as a modified fan request signal having a value that is a product of the multiplier and the initial fan request signal value when the oil temperature exceeds the oil threshold temperature. In another embodiment, determining the applied fan request signal further comprises determining an adder, and determining the applied fan request signal as a modified fan request signal having a value that is a sum of the adder and the initial fan request signal value when the oil temperature exceeds the oil threshold temperature.

Still further, in carrying out the present invention, a method of controlling an internal combustion engine is provided. The engine is housed in an engine compartment and includes a hydraulically driven variable speed fan wherein hydraulic oil is pumped by a pump to drive a hydraulic fan motor. The variable speed fan is selectively driven in response to an applied fan request signal based on engine operating conditions. The applied fan request signal has a value between a maximum fan request value and a minimum fan request value. The engine is operable over an engine speed range between an idle speed and a full speed. The method comprises establishing an engine compartment temperature threshold, monitoring a temperature in the engine compartment, and in the presence of the applied fan request signal, driving the hydraulic fan motor with the pump to drive the fan in accordance with the applied fan request signal. In the absence of the applied fan request signal, the method comprises effectively disabling the fan when the temperature falls below the threshold, and otherwise, driving the hydraulic fan motor with the pump to drive the fan at a predetermined speed. The predetermined speed may be a maximum fan speed, or may be a programmable fan speed.

In one embodiment, the pump is a variable displacement pump and effectively disabling the fan further comprises controlling the pump so that there is not any effective pump displacement. In another embodiment, disabling the fan further comprises providing a bypass such that the hydraulic oil that is pumped by the pump bypasses the fan hydraulic motor so that there is not any effective drive to the fan motor. In some embodiments, the engine compartment temperature is an engine compartment air temperature, while in other embodiments, the engine compartment temperature is an intake manifold air temperature.

Even further, in carrying out the present invention, a method of controlling an internal combustion engine in a vehicle having a transmission is provided. The engine includes a variable speed fan and the transmission includes transmission oil. The variable speed fan is driven in response to an applied fan request signal based on engine conditions having a value between the maximum fan request value and the minimum fan request value. The engine is operable over an engine speed range between an idle speed and a full speed. The method comprises establishing a transmission oil threshold temperature for the transmission oil, monitoring a temperature of the transmission oil, and determining a plurality of preliminary initial fan request signals. Each request signal has a value based on at least one engine condition. The transmission oil initial fan request signal is based on the transmission oil temperature and the threshold temperature. The method further comprises determining the applied fan request signal as the initial fan request signal with the greatest value. In a suitable application, the transmission oil temperature is monitored at the transmission oil sump.

Yet further, in carrying out the invention, a method of controlling an internal combustion engine in a vehicle having an air-conditioning system is provided. The engine includes a variable speed fan and the air-conditioning system includes a condenser for transferring heat from a refrigerant during operation. A method comprises establishing a condenser threshold pressure, monitoring a pressure in the condenser, and determining a plurality of preliminary initial fan request signals. Each request signal has a value based on at least one engine condition. A condenser initial fan request signal is based on the condenser pressure and the threshold pressure. The method further comprises determining the applied fan request signal as the initial fan request signal with the greatest value. Of course, it is appreciated that the relationship between condenser pressure and the associated fan request may vary depending on the refrigerant used. Further, the condenser pressure fan request is preferably programmable to allow the fan to operate at a programmed fan speed when condenser pressure is excessive.

The advantages associated with embodiments of the present invention are numerous. For example, in embodiments of the present invention, a variable speed cooling fan is aggressively controlled using one or more of the above methods so that the fan is run at a fan speed that is sufficient to provide adequate engine cooling but the fan is controlled to avoid fuel inefficiencies associated with more conservative fan control strategies of the prior art. In accordance with the present invention, various control techniques may be used alone or together to effectively control the variable speed cooling fan and internal combustion engine to provide fuel efficient operation. Further, in accordance with the present invention, computer readable storage media are provided. A medium of the present invention has instructions stored thereon that are executable by a controller to perform a method of controlling an internal combustion engine in accordance with the control strategies described herein.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
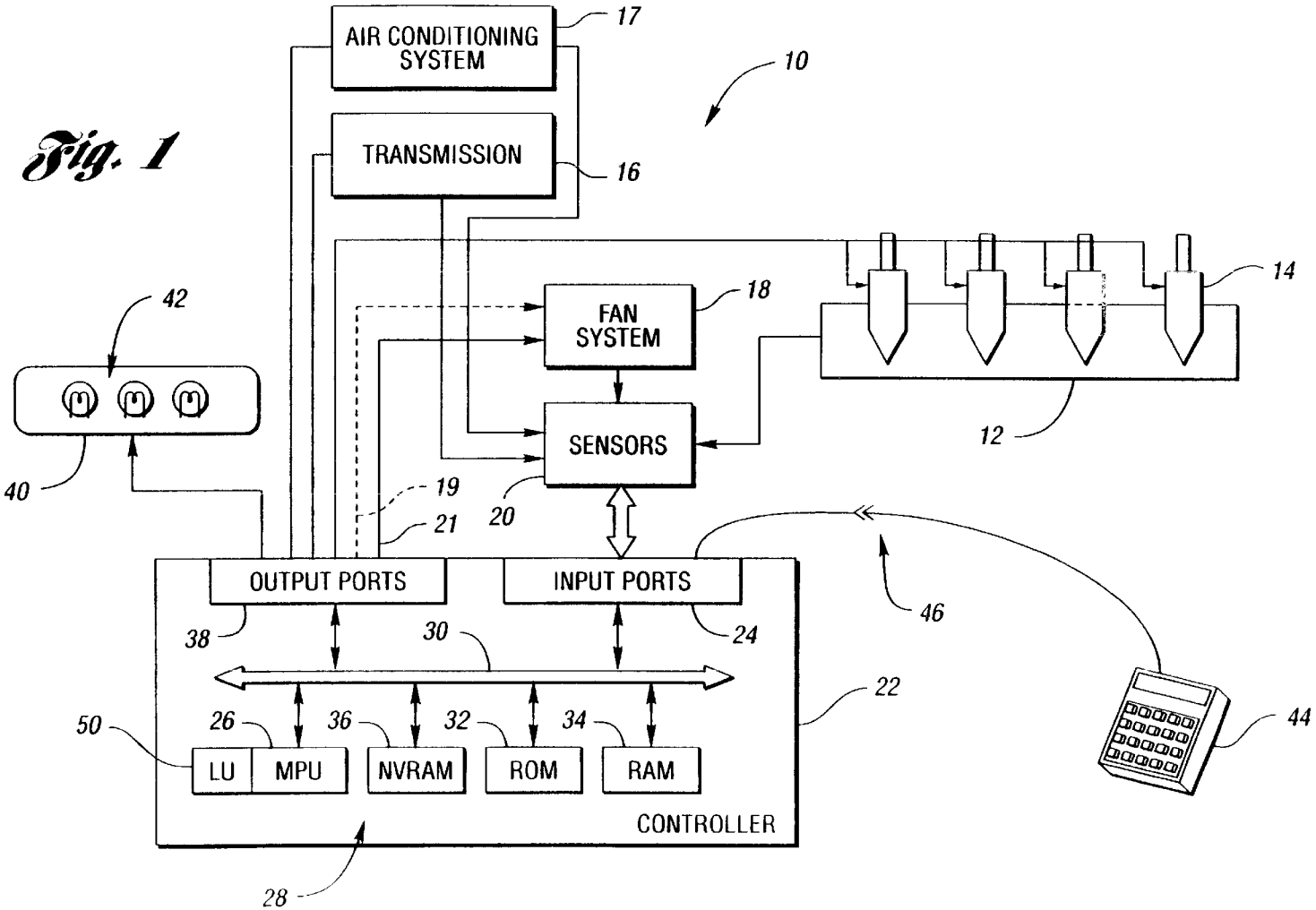
FIG. 1 is a schematic diagram of an engine and engine control system made in accordance with the present invention.

With reference to FIG. 1, an internal combustion engine and associated control systems and subsystems are generally indicated at 10. System 10 includes an engine 12 having a plurality of cylinders, each fed by fuel injectors 14. In a preferred embodiment, engine 12 is a compression-ignition internal combustion engine, such as a heavy duty diesel fuel engine. Injectors 14 receive pressurized fuel from a fuel supply in a known manner.

System 10 also includes a vehicle transmission 16 and a fan system 18. Fan system 18, and the various embodiments of the present invention, may suitably be implemented as an electrically driven fan system, a hydraulically driven fan system, or a direct drive system with a variable fan clutch. It is appreciated that some embodiments of the present invention are most suited for a hydraulically driven fan system, but some embodiments may be used alternatively with other types of fan systems. Sensors 20 are in electrical communication with a controller 22 via input ports 24. Controller 22 preferably includes a microprocessor 26 in communication with various computer readable storage media 28 via data and control bus 30. Computer readable storage media 28 may include any of a number of known devices which function as read only memory 32, random access memory 34, and non-volatile random access memory 36.

Computer readable storage media 28 have instructions stored thereon that are executable by controller 22 to perform methods of controlling the internal combustion engine, including variable speed fan system 18. The program instructions direct controller 22 to control the various systems and subsystems of the vehicle, with the instructions being executed by microprocessor 26, and optionally, instructions may also be executed by any number of logic units 50. Input ports 24 receive signals from sensors 20, and controller 22 generates signals at output ports 38 that are directed to the various vehicle components. The signals may be provided to a display device 40 which includes various indicators such as lights 42 to communicate information relative to system operation to the operator of the vehicle.

A data, diagnostics, and programming interface 44 may also be selectively connected to controller 22 via a plug 46 to exchange various information therebetween. Interface 44 may be used to change values within the computer readable storage media 28, such as configuration settings, calibration variables, temperature thresholds for variable speed fan control, and others.

In operation, controller 22 receives signals from sensors 20 and executes control logic embedded in hardware and/or software to control the engine, including controlling variable speed fan system 18. In a preferred embodiment, controller 22 is the DDEC controller available from Detroit Diesel Corporation, Detroit, Mich. Various other features of this controller are described in detail in a number of different U.S. patents assigned to Detroit Diesel Corporation. In particular, fan system 18 is controlled by an applied fan request signal 21 that commands the fan system. The applied fan request signal is generated by controller 22 based on any number of different factors such as various temperatures at different parts of the engine. Further, in accordance with the present invention, controller 22 processes a plurality of initial fan request signals using various techniques of the present invention to arrive at the final applied fan request signal that is sent to fan system 18. Further, in some implementations, additional information may also be supplied to fan system 18 as indicated by dashed line 19. The additional information such as, for example, an engine compartment temperature at a predetermined engine compartment hot spot, may be provided to fan system 18, such that fan system 18 may modify fan operation without strictly controlling the fan in accordance with the applied fan request 21. For example, fan system 18 may effect special control of the fan system, for example, during a cold engine start up as determined by a temperature at input 19.

As is appreciated by one of ordinary skill in the art, control logic may be implemented in hardware, firmware, software, or combinations thereof. Further, control logic may be executed by controller 22, in addition to by any of the various systems and subsystems of the vehicle cooperating with controller 22. Further, although in a preferred embodiment, controller 22 includes microprocessor 26, any of a number of known programming and processing techniques or strategy may be used to control an engine in accordance with the present invention.

Further, it is to be appreciated that the engine controller may receive information in a variety of ways. For example, transmission information could be received over a data link, at a digital input or at a sensor input of the engine controller. Continuing with the transmission information example, transmission parameters such as transmission oil sump temperature, transmission retarder status, etc., may be received over a digital communication data link. The data link could be in accordance with a Society of Automotive Engineers (SAE) protocol, such as SAE J1587 or SAE J1939.

When a digital input to the engine controller is used to receive information, a twisted pair could be hard wired to the engine controller digital input, from the transmission. The digital input could then be left open (high) or pulled to ground to indicate information such as transmission retarder status as active or inactive, respectively. In another digital input example, a temperature switch could be hard wired to the digital input such that open indicates a temperature above a threshold while closed (pulled to ground) indicates a normal temperature (below the threshold).

And further, in the example, a sensor such as a sensor with an analog output could be wired to a sensor input of the engine controller. Further, it is appreciated that transmission information is an example, and the above techniques and others may be employed to provide other types of information to the engine controller.

Figure 2:
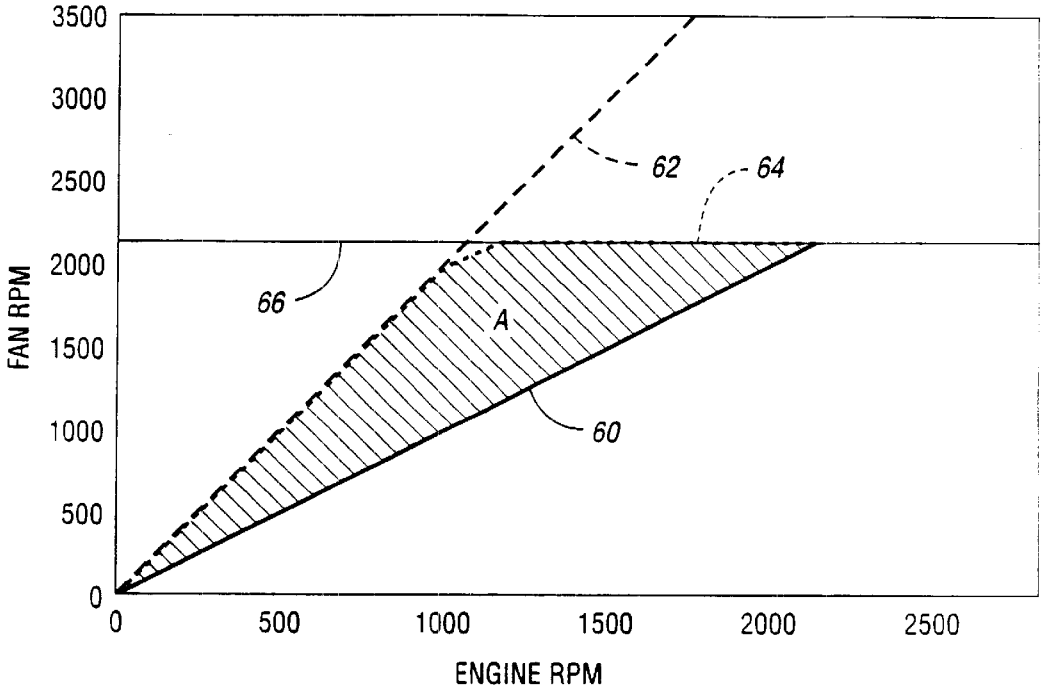
FIG. 2 is a graph depicting fan rpm versus engine rpm in one embodiment of the present invention.

With reference to FIG. 2, a graph depicts fan speed in revolutions per minute versus engine speed in revolutions per minute. In an existing engine, the engine controller determines an applied fan request, and passes the request to the fan system. The fan system, in turn, drives the fan in accordance with the applied fan request. In an existing system, applied fan request is limited by a fixed request limit. The request limit is determined as the request at which the fan speed is the highest allowable fan speed while the engine is at the highest allowable engine speed. As such, maximum available fan speed varies linearally with engine speed such that higher fan speeds are not available at lower engine speeds. This phenomenon is indicated at plot 60 in solid line.

In accordance with the present invention, it is desirable to provide a fan control system that uses engine speed to modify the applied fan request limit to provide the capability of operating at higher fan speeds at lower engine speeds. In accordance with this embodiment of the present invention, a fan speed limit is established. The fan speed limit is the maximum allowable fan speed during operation of the engine at all engine speeds in the engine speed range. In the plot, the fan speed limit is indicated at thin solid line 66. The fan request limit is increased from the existing system. That is, the maximum fan request value is sufficiently large to cause the fan speed to approach the fan speed limit as the engine speed approaches an intermediate speed between the idle speed and the full speed. This is best shown at dashed line 62. Accordingly, at engine speeds up to 1000 rpm, higher fan speeds are allowed compared to existing system performance line 60. To avoid overspeeding the fan, in accordance with the present invention, the applied fan request signal is determined by limiting the initial fan request signal based on engine speed such that the fan speed approaches the fan speed limit as the engine speed approaches the intermediate speed and the fan speed remains below the fan speed limit as the engine speed approaches the full speed. That is, short dashed line 64 indicates fan speed when maximum fan speed is requested as the engine speed goes from 0 to 2,000 rpm. As shown, while the maximum fan speed is requested, the fan speed increases rapidly up to the fan speed limit as engine rpm approaches 1,000 rpm, and then fan speed (while maximum fan speed is being requested) stays near the fan speed limit as engine rpm continues to increase up to 2,000 rpm. Advantageously, it is appreciated that in accordance with the present invention, it is possible to operate the fan anywhere below short dashed line 64. This is advantageous over an existing system that only allows fan operation at points falling below solid line 60. In particular, this embodiment of the present invention allows operation of the variable speed fan in the cross-hatched region indicated by A, and it is believed that there are no existing systems that limit the applied fan request signal by limiting the initial fan request signal based on engine speed as described above.

Figure 3:
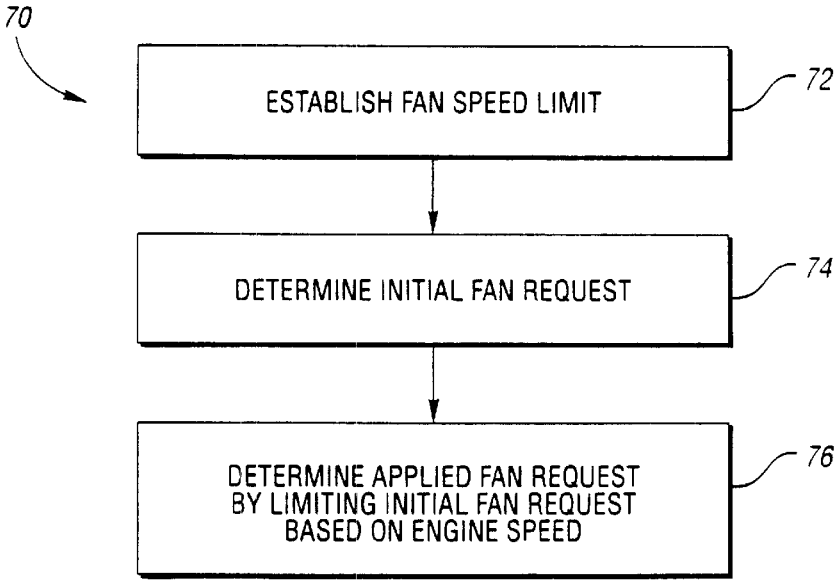
FIG. 3 is a block diagram illustrating a method of the present invention.

The above-described method of the present invention may be better understood with reference to block diagram 70 illustrated in FIG. 3. At block 72, a fan speed limit is established (line 66). At block 74, an initial fan request is determined. At block 76, applied fan request is determined by limiting initial fan request based on engine speed to allow higher fan speeds at lower engine speeds, while avoiding fan overspeed at high engine speeds.

In preferred embodiments, fan speed is monitored, and engine speed is limited, as needed, to prevent the applied fan request signal from causing the fan speed to exceed the fan speed limit. Although, applied fan request is limited to avoid fan overspeed, it is desired to provide an additional level of safety by limiting engine speed in the event that fan speed does happen to increase beyond the fan speed limit. Further, in a suitable implementation, the initial fan request signal, before limiting, is determined as the maximum signal out of a plurality of preliminary initial fan request signals. For example, various different fan requests may be made by various different systems and subsystems of the engine, with the initial fan request (before limiting) being the greatest fan request present.

Figure 4:
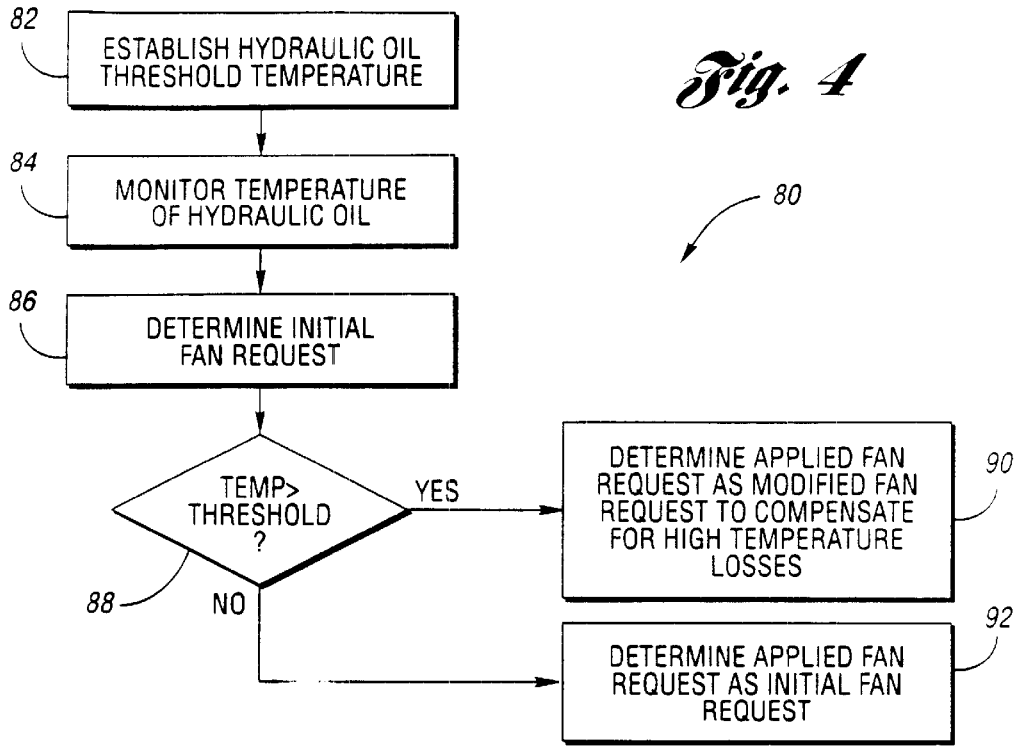
FIG. 4 is a block diagram illustrating a method of the present invention.

With reference to FIG. 4, a method of the present invention is generally indicated at 80. This embodiment of the present invention is suitable for a hydraulically driven variable speed fan wherein hydraulic oil is pumped by a pump to drive the hydraulic fan motor. A variable speed fan is driven in response to an applied fan request signal. In this embodiment, the applied fan request signal is modified based on hydraulic oil temperature to compensate for system losses when hydraulic oil temperature exceeds a predetermined hydraulic oil threshold temperature. At block 82, a hydraulic oil threshold temperature is determined. At block 84, the temperature of the hydraulic oil in the fan system is monitored. At block 86, an initial fan request is determined. At decision block 88, the monitored temperature is compared to the threshold temperature.

When the monitored temperature does not exceed the threshold temperature, at block 92, applied fan request is determined as the initial fan request (without modification because oil temperature is low enough to avoid significant losses). When the measured temperature exceeds the threshold, at block 90, applied fan request is determined as a modified fan request to compensate for high temperature losses. In one embodiment, the applied fan request signal is determined as a modified fan request signal having a value that is a product of a multiplier and the initial fan request signal. In another embodiment, the applied fan request signal is determined as a modified fan request signal having a value that is a sum of an adder and the initial fan request signal value.

Figure 5:
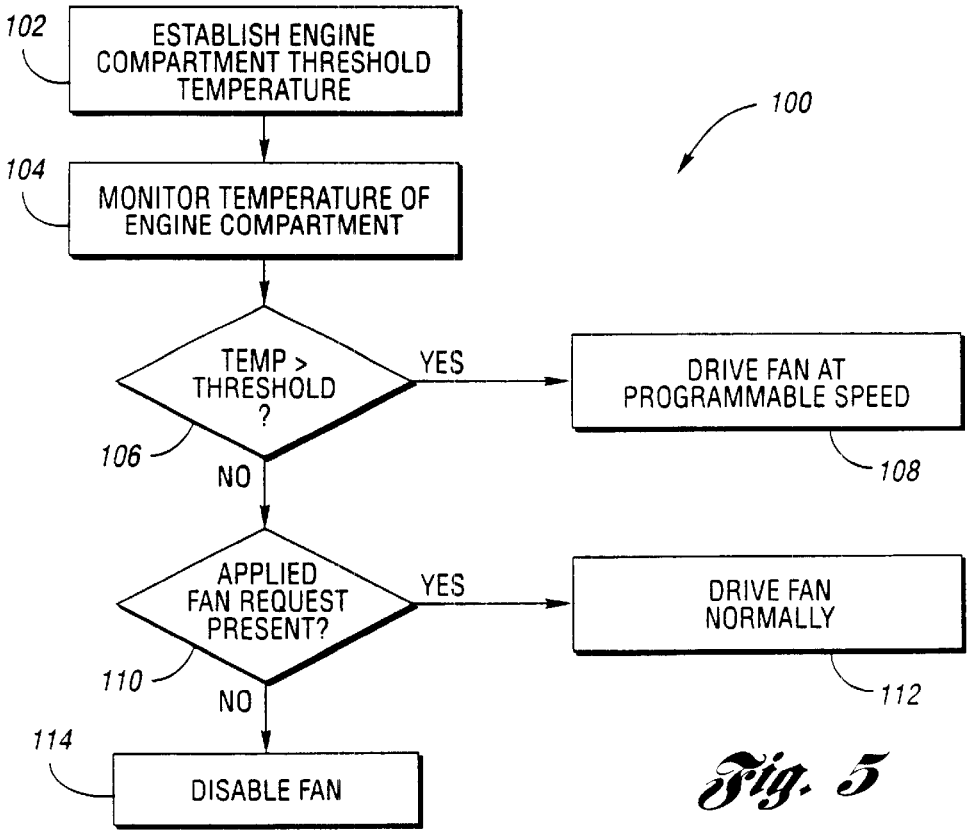
FIG. 5 is a block diagram illustrating a method of the present invention.

In another embodiment of the present invention, illustrated in block diagram 100 of FIG. 5, a hydraulic fan system is disabled completely based on engine compartment temperature and fan request. A primary disadvantage with hydraulically driven fan control systems is that the fan never shuts off completely (in typical systems). Typically, hydraulic fans may operate between 250 and 800 fan rpm during engine idle operation when there is no request for fan speed. A continuous fan operation may result in fuel economy loss, engine overcooling during cold weather operation, and additional fan noise. Presently, some equipment manufacturers are willing to tolerate continuous fan operation primarily for two reasons. First, there have been no alternatives. Second, some equipment manufacturers desire a minimum fan speed due to concerns that no fan operation may result in component failures due to high engine compartment temperatures.

Figure 6:
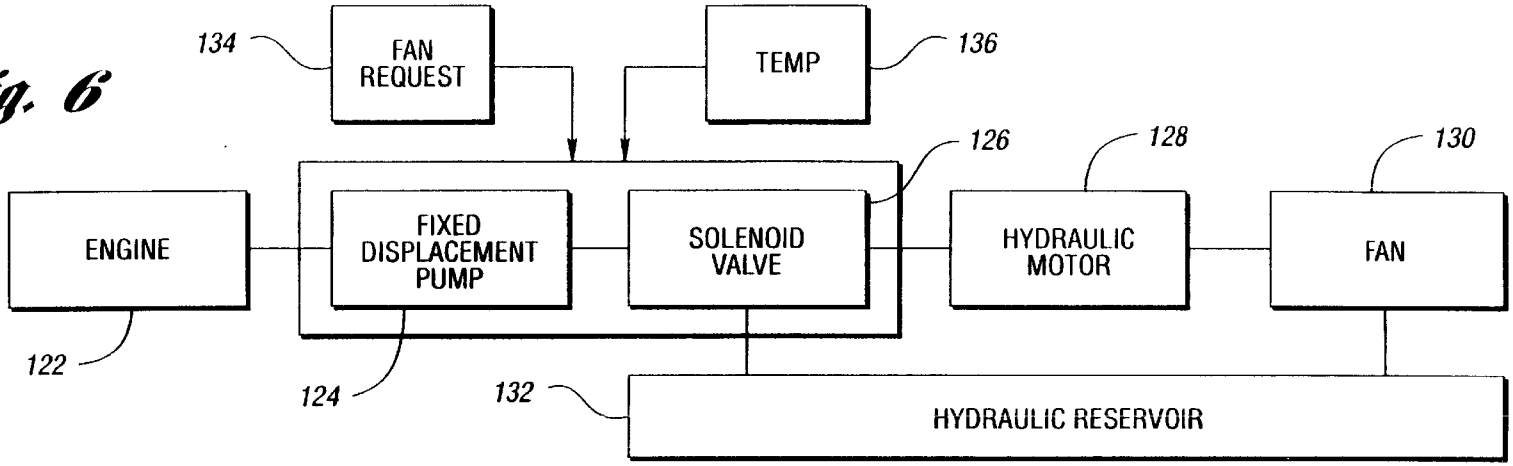
FIG. 6 is a block diagram illustrating a system for one embodiment of the present invention.
Figure 7:
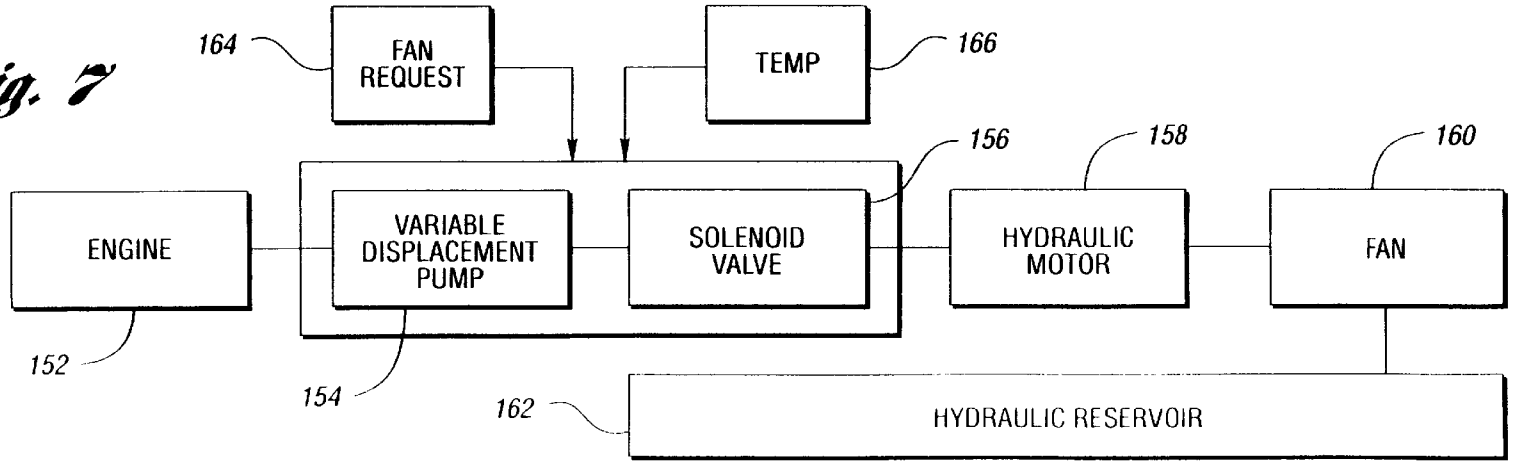
FIG. 7 is a block diagram illustrating an alternative system for an embodiment of the present invention.

In accordance with the present invention, the method illustrated in FIGS. 5–7 utilizes a solenoid valve between the hydraulic fan pump and the hydraulically driven fan motor that is control based on input from both the engine controller (22, FIG. 1) and an engine compartment temperature input (from sensors 20). The solenoid valve should be normally open (not inhibiting hydraulic oil flow to the fan motor). If there is no request from the controller and the engine compartment temperature is within the equipment manufacturer's specifications, the solenoid valve outlet to the fan motor should be closed, inhibiting oil flow to the motor and improving fuel economy. That is, in accordance with this embodiment of the present invention, in the absence of the applied fan request signal, the fan system is effectively disabled when the temperature falls below a threshold (manufacturer's recommended upper temperature), and otherwise, the hydraulic fan motor is driven with the pump to drive the fan at a predetermined speed to maintain a temperature within specification.

As best shown in FIG. 5, at block 102, an engine compartment threshold temperature is established. This threshold temperature may be an engine compartment air temperature, or alternatively, may be an intake manifold air temperature. At block 104, temperature of the engine compartment is monitored. At decision block 106, the engine compartment temperature is compared to the engine compartment threshold temperature. When the engine compartment temperature exceeds the threshold temperature, the fan is driven at a predetermined, and preferably programmable speed at block 108. However, in accordance with the present invention, when the temperature does not exceed the threshold, flow proceeds to block 110. If there is an applied fan request present, flow proceeds to block 112 where the fan is driven normally. In the absence of an applied fan request, flow proceeds to block 114, and the hydraulic fan is completely disabled to improve fuel economy and particularly, to avoid overcooling the engine during cold weather operation when the engine is still cold.

The hydraulic fan may be disabled by closing the solenoid valve, with examples being shown in FIGS. 6 and 7. In FIG. 6, engine 122 drives a fixed displacement pump 124 to communicate hydraulic oil through solenoid valve 126 to hydraulic motor 128. Hydraulic motor 128 spins fan 130. Solenoid valve 126 is a three-way valve having a bypass to hydraulic reservoir 132. The fan system receives fan request 134 and engine compartment temperature 136.

When it is desirable to completely and effectively disable the hydraulic fan because the engine is cool and the fan request is absent, the three-way solenoid valve may function as a bypass valve which circulates the hydraulic fluid through a less restrictive passage and back to the hydraulic reservoir.

A variable displacement system is shown in FIG. 7. In FIG. 7, engine 152 drives variable displacement pump 154 to pump hydraulic oil through solenoid valve 156 to drive hydraulic motor 158. Hydraulic motor 158, in turn, drives fan 160, and hydraulic oil returns to hydraulic reservoir 162. The two-way solenoid valve may function to effectively disable hydraulic oil flow by deadheading the pump, which in turn forces back the squash plate reducing the power consumed by the variable displacement pump.

In accordance with the present invention, this method of variable speed fan control eliminates some of the fuel economy losses incurred from the hydraulic pump as it consumes power to keep the fan continuously operating. It also reduces fuel economy loss due to lower engine oil temperatures that in prior systems are prolonged due to fan operation at cold start up of the engine. The control strategy also reduces the possibility of engine overcooling during cold weather operation by turning the fan completely off whenever engine compartment temperatures are within acceptable range limits and there is no applied fan request for fan speed. This method also provides a noise reduction by completely disabling the fan when the fan is not required.

Figure 8:
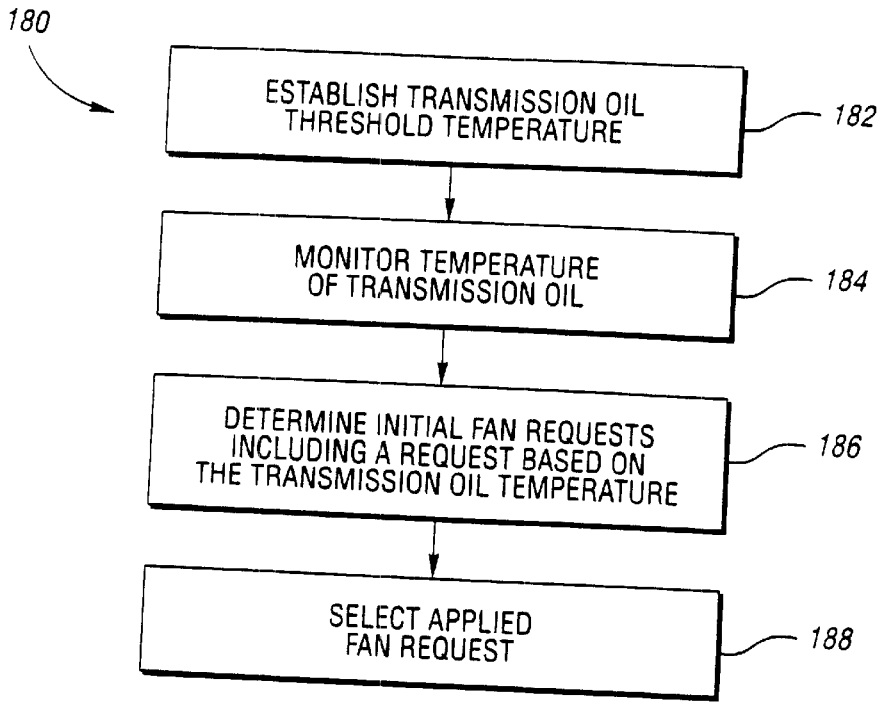
FIG. 8 is a block diagram illustrating yet another embodiment of the present invention.

In accordance with the present invention, any of the above methods may be used alone or in combination to effectively control a variable speed fan which in some embodiments, is a hydraulically driven fan. In FIG. 8, another method of the present invention is generally indicated at 180. Vehicles utilizing transmission oil to water oil coolers are typically plumbed such that the coolant from the engine water pump outlet flows directly to the transmission oil cooler. The coolant is then plumbed to the engine oil cooler from the transmission oil cooler. Testing, by the inventors, has indicated that there are certain operating conditions in which the transmission oil may potentially exceed transmission manufacturer's recommendations without requesting maximum fan speed based on existing fan control inputs (temperature at the engine oil). Examples of existing fan control inputs are inputs for air temperature, coolant temperature, inner cooler temperature, oil temperature, manual fan control, and fan based on transmission retarder. This control strategy of the method shown in FIG. 8 employs measuring transmission sump oil temperature.

In block 182, a transmission oil threshold temperature is established. At block 184, the temperature of the transmission oil is monitored. At block 186, initial fan requests, including a request based on the transmission oil temperature are determined. At block 188, an applied fan request is selected. It is appreciated that, for the very first time, an initial fan request is based on the transmission oil temperature such that the transmission oil will not overheat without the fan coming on beforehand.

Figure 9:
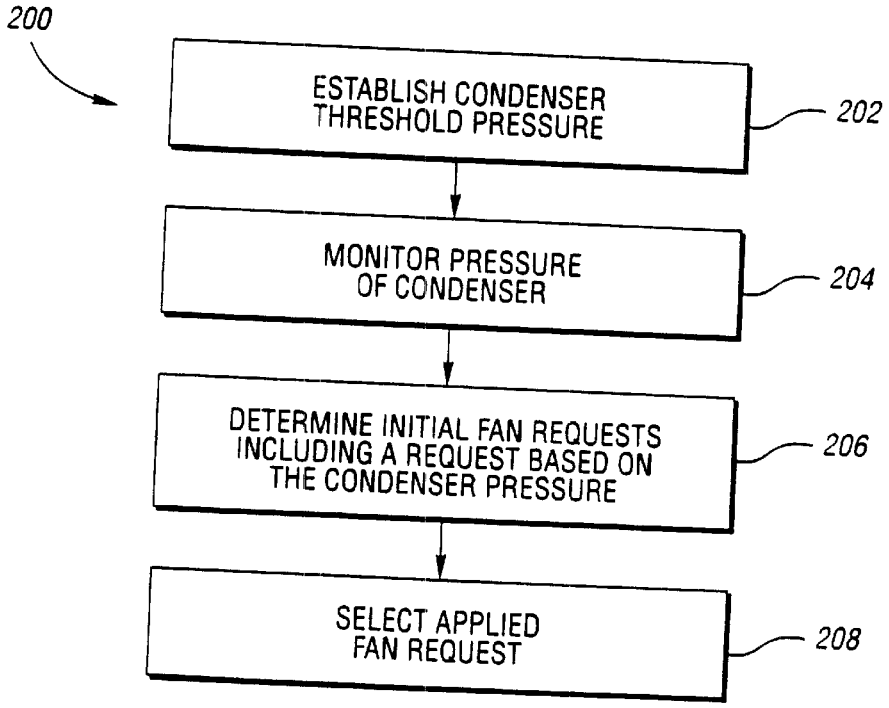
FIG. 9 is a block diagram illustrating still another embodiment of the present invention.

In yet another embodiment of the present invention, as shown in a block diagram of FIG. 9 at 200, an additional fan input may represent condenser pressure in a vehicle having an air-conditioning system (17, FIG. 1). At block 202, a condenser pressure threshold is established. At block 204, the pressure in the condenser is monitored. At block 206, initial fan requests are determined, including a request based on the condenser pressure. At block 208, the fan request is selected from the initial fan request. It is appreciated that, for the very first time, an initial fan request is based on the condenser pressure.

It is appreciated that embodiments of the present invention use various control strategies to improve control of a variable speed fan. Variable speed fans may provide increased fuel economy while reducing vehicle noise and improving engine durability. Fuel economy may be improved if fan operation can be minimized by only operating the fan at the speed required to provide sufficient cooling as opposed to operating the fan at a fixed speed ratio versus engine speed which is based on cooling system testing under worst case operating conditions. There are some losses due to the efficiencies of the components that must be taken into account when assessing a potential fuel economy benefit.

Further, vehicle noise is similarly reduced since fan speed is minimized by only operating the fan at the speed required to provide sufficient cooling. It should be noted that fan noise is generated as a function of fan tip speed. Also, the harsh noise generated when an on/off fan is enabled is eliminated with the DDEC variable speed method of fan controls which gradually increases the fan request to the desired rate.

Finally, implementation of the proposed control strategy on a hydraulic system may result in increased engine durability. This is primarily due to increasing the engine air inlet manifold temperatures during cold weather operation by turning the fan completely off when not required. Many of today's fuel efficient engines require charge air cooling (CAC). Charge air cooling refers to the cooling of the turbocharger compressor outlet air via an external fan cooled heat exchanger prior to its delivery to the engine air inlet manifold. Fan operation in cold weather may cause excessively cold engine air inlet temperatures which may result in engine damage. Furthermore, there is some coolant flow through the engine coolant heat exchanger which may also contribute to engine over cooling during cold weather operation. The coolant flow through the heat exchanger is a result of cooling system vent lines installed in the engine, radiator, and auxiliary heat exchangers such as transmission coolers to ensure the cooling system is properly deaerated. Lower temperature coolant may result in lower engine oil temperatures. Engines are less fuel efficient during operation with low oil temperature. A general rule of thumb is that fuel economy is improved 1% for every 10° F. oil temperature increase up to normal operating temperature.

This method of variable speed fan control is intended to provide an improved fan control strategy in order to improve fuel economy, reduce noise, and to increase engine reliability and durability by decreasing the possibility of engine over cooling during cold weather operation.

Further, in some embodiments of the present invention, it may be desirable to assist operators in improving operations by recording fan on-time (and request sources) under trip data in the computer readable storage media at the engine controller. This allows later analysis of the fan operation after a vehicle trip in the event that the operator is wondering how well the fan is performing.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of control an internal combustion engine, the engine including a variable speed fan, the variable speed fan being driven in response to an applied fan request signal having a value between a predetermined maximum fan request value and a predetermined minimum fan request value, the engine being operable over an engine speed range between an idle speed and a full speed, the method comprising:

establishing a fan speed limit as a maximum allowable fan speed during operation of the engine at all engine speeds in the engine speed range;

determining an initial fan request signal based on engine operating conditions and having a value between the minimum fan request value and the maximum fan request value, wherein the maximum fan request value is sufficiently large to cause the fan speed to approach the fan speed limit as the engine speed approaches an intermediate speed between the idle speed and the full speed; and determining the applied fan request signal by limiting the initial fan request signal based on engine speed such that the fan speed approaches the fan speed limit as the engine speed approaches the intermediate speed and the fan speed remains below the fan speed limit as the engine speed approaches the full speed, while the initial fan request signal value is the maximum fan request value, allowing higher fan speeds at lower engine speeds while avoiding fan overspeed at higher engine speeds.

2. The method of claim 1 further comprising:

monitoring the fan speed; and limiting engine speed, as needed, to prevent the applied fan request signal from causing the fan speed to exceed the fan speed limit.

3. The method of claim 1 wherein determining the initial fan request signal further comprises:

determining a plurality of preliminary initial fan request signals, each request signal having a value based on at least one engine condition; and determining the initial fan request signal as the preliminary fan request signal having the greatest value.

4. The method of claim 1 wherein the variable speed fan is a hydraulically driven fan wherein hydraulic oil is pumped by a pump to drive a hydraulic fan motor.

5. A method of controlling an internal combustion engine, the engine including a hydraulically driven variable speed fan wherein hydraulic oil is pumped by a pump to drive a hydraulic fan motor, the variable speed fan being driven in response to an applied fan request signal having a value between a maximum fan request value and a minimum fan request value, the engine being operable over an engine speed range between an idle speed and a full speed, the method comprising:

establishing a hydraulic oil threshold temperature for the hydraulic oil that drives the fan motor;

monitoring a temperature of the hydraulic oil;

determining an initial fan request signal having a value between the minimum fan request value and the maximum fan request value; and determining the applied fan request signal as the initial fan request signal when the oil temperature falls below the oil threshold temperature, and determining the applied fan request signal as a modified fan request signal having a value greater than the initial fan request signal value to compensate for losses due to increased hydraulic oil temperature when the oil temperature exceeds the oil threshold temperature.

6. The method of claim 5 wherein determining the applied fan request signal further comprises:

determining a multiplier; and determining the applied fan request signal as a modified fan request signal having a value that is a product of the multiplier and the initial fan request signal value when the oil temperature exceeds the oil threshold temperature.

7. The method of claim 5 wherein determining the applied fan request signal further comprises:

determining an adder; and determining the applied fan request signal as a modified fan request signal having a value that is a sum of the adder and the initial fan request signal value when the oil temperature exceeds the oil threshold temperature.

8. A method of controlling an internal combustion engine, the engine being housed in an engine compartment and including a hydraulically driven variable speed fan wherein hydraulic oil is pumped by a pump to drive a hydraulic fan motor, the variable speed fan being selectively driven in response to an applied fan request signal based on engine operating conditions having a value between a maximum fan request value and a minimum fan request value, the engine being operable over an engine speed range between an idle speed and a full speed, the method comprising:

establishing an engine compartment temperature threshold;

monitoring a temperature in the engine compartment;

in the presence of the applied fan request signal, driving the hydraulic fan motor with the pump to drive the fan in accordance with the applied fan request signal; and in the absence of the applied fan request signal, effectively disabling the fan when the temperature falls below the threshold, and otherwise, driving the hydraulic fan motor with the pump to drive the fan at a predetermined speed.

9. The method of claim 8 wherein the pump is a variable displacement pump and wherein effectively disabling the fan further comprises:

controlling the pump so that there is not any effective pump displacement.

10. The method of claim 8 where in effectively disabling the fan further comprises:

providing a bypass such that hydraulic oil that is pumped by the pump bypasses the hydraulic fan motor so that there is not any effective drive to the fan motor.

11. The method of claim 8 wherein the engine compartment temperature is an engine compartment air temperature.

12. The method of claim 11 wherein the engine compartment temperature is an intake manifold air temperature.

13. A method of-controlling an internal combustion engine in a vehicle having a transmission, the engine including a variable speed fan and the transmission including transmission oil, the variable speed fan being driven in response to an applied fan request signal based on engine conditions having a value between a maximum fan request value and a minimum fan request value, the engine being operable over an engine speed range between an idle speed and a full speed, the method comprising:

establishing a transmission oil threshold temperature for the transmission oil;

monitoring a temperature of the transmission oil;

determining a plurality of preliminary initial fan request signals, each request signal having a value based on at least one engine condition, wherein a transmission oil initial fan request signal is based on the transmission oil temperature and the threshold temperature; and determining the applied fan request signal as the initial fan request signal with the greatest value.

14. The method of claim 13 wherein the transmission has an oil sump and wherein monitoring the temperature of the transmission oil further comprises:

monitoring the temperature of the transmission oil at the transmission oil sump.

15. A method of controlling an internal combustion engine in a vehicle having an air conditioning system, the engine including a variable speed fan and the air conditioning system including a condenser for transferring heat from a refrigerant during operation, the variable speed fan being driven in response to an applied fan request signal based on engine conditions and having a value between a maximum fan request value and a minimum fan request value, the engine being operable over an engine speed range between an idle speed and a full speed, the method comprising:

establishing a condenser threshold pressure;

monitoring a pressure in the condenser;

determining a plurality of preliminary initial fan request signals, each request signal having a value based on at least one engine condition, wherein a condenser initial fan request signal is based on the condenser pressure and the threshold pressure; and determining the applied fan request signal as the initial fan request signal with the greatest value.

16. A computer readable storage medium having instructions stored thereon that are executable by a controller to perform a method of controlling an internal combustion engine, the engine including a variable speed fan, the variable speed fan being driven in response to an applied fan request signal having a value between a predetermined maximum fan request value and a predetermined minimum fan request value, the engine being operable over an engine speed range between an idle speed and a full speed, the medium further comprising:

instructions for establishing a fan speed limit as a maximum allowable fan speed during operation of the engine at all engine speeds in the engine speed range;

instructions for determining an initial fan request signal based on engine operating conditions and having a value between the minimum fan request value and the maximum fan request value, wherein the maximum fan request value is sufficiently large to cause the fan speed to approach the fan speed limit as the engine speed approaches an intermediate speed between the idle speed and the full speed; and instructions for determining the applied fan request signal by limiting the initial fan request signal based on engine speed such that the fan speed approaches the fan speed limit as the engine speed approaches the intermediate speed and the fan speed remains below the fan speed limit as the engine speed approaches the full speed, while the initial fan request signal value is the maximum fan request value, allowing higher fan speeds at lower engine speeds while avoiding fan overspeed at higher engine speeds.

17. The medium of claim 16 further comprising:

instructions for monitoring the fan speed; and instructions for limiting engine speed, as needed, to prevent the applied fan request signal from causing the fan speed to exceed the fan speed limit.

18. The medium of claim 16 wherein the instructions for determining the initial fan request signal further comprise:

instructions for determining a plurality of preliminary initial fan request signals, each request signal having a value based on at least one engine condition; and instructions for determining the initial fan request signal as the preliminary fan request signal having the greatest value.

19. The medium of claim 16 wherein the variable speed fan is a hydraulically driven fan wherein hydraulic oil is pumped by a pump to drive a hydraulic fan motor.

20. A computer readable storage medium having instructions stored thereon that are executable by a controller to perform a method of controlling an internal combustion engine, the engine including a hydraulically driven variable speed fan wherein hydraulic oil is pumped by a pump to drive a hydraulic fan motor, the variable speed fan being driven in response to an applied fan request signal having a value between a maximum fan request value and a minimum fan request value, the engine being operable over an engine speed range between an idle speed and a full speed, the medium further comprising:

instructions for establishing a hydraulic oil threshold temperature for the hydraulic oil that drives the fan motor;

instructions for monitoring a temperature of the hydraulic oil;

instructions for determining an initial fan request signal having a value between the minimum fan request value and the maximum fan request value; and instructions for determining the applied fan request signal as the initial fan request signal when the oil temperature falls below the oil threshold temperature, and determining the applied fan request signal as a modified fan request signal having a value greater than the initial fan request signal value to compensate for losses due to increased hydraulic oil temperature when the oil temperature exceeds the oil threshold temperature.

21. The medium of claim 20 wherein the instructions for determining the applied fan request signal further comprise:

instructions for determining a multiplier; and instructions for determining the applied fan request signal as a modified fan request signal having a value that is a product of the multiplier and the initial fan request signal value when the oil temperature exceeds the oil threshold temperature.

22. The medium of claim 20 wherein the instructions for determining the applied fan request signal further comprise:

instructions for determining a adder; and instructions for determining the applied fan request signal as a modified fan request signal having a value that is a sum of the adder and the initial fan request signal value when the oil temperature exceeds the oil threshold temperature.

23. A computer readable storage medium having instructions stored thereon that are executable by a controller to perform a method of controlling an internal combustion engine, the engine being housed in an engine compartment and including a hydraulically driven variable speed fan wherein hydraulic oil is pumped by a pump to drive a hydraulic fan motor, the variable speed fan being selectively driven in response to an applied fan request signal based on engine operating conditions having a value between a maximum fan request value and a minimum fan request value, the engine being operable over an engine speed range between an idle speed and a full speed, the medium further comprising:

instructions for establishing an engine compartment temperature threshold;

instructions for monitoring a temperature in the engine compartment;

instructions for, in the presence of the applied fan request signal, driving the hydraulic fan motor with the pump to drive the fan in accordance with the applied fan request signal; and instructions for, in the absence of the applied fan request signal, effectively disabling the fan when the temperature falls below the threshold, and otherwise, driving the hydraulic fan motor with the pump to drive the fan at a predetermined speed.

24. The medium of claim 23 wherein the pump is a variable displacement pump and wherein the instructions for effectively disabling the fan further comprise:

instructions for controlling the pump so that there is not any effective pump displacement.

25. The medium of claim 23 wherein the instructions for effectively disabling the fan further comprise:

instructions for providing a bypass such that hydraulic oil that is pumped by the pump bypasses the hydraulic fan motor so that there is not any effective drive to the fan motor.

26. The medium of claim 23 wherein the engine compartment temperature is an engine compartment air temperature.

27. The medium of claim 26 wherein the engine compartment temperature is an intake manifold air temperature.

28. A computer readable storage medium having instructions stored thereon that are executable by a controller to perform a method of controlling an internal combustion engine in a vehicle having a transmission, the engine including a variable speed fan and the transmission including transmission oil, the variable speed fan being driven in response to an applied fan request signal based on engine conditions having a value between a maximum fan request value and a minimum fan request value, the engine being operable over an engine speed range between an idle speed and a full speed, the medium further comprising:

instructions for establishing a transmission oil threshold temperature for the transmission oil;

instructions for monitoring a temperature of the transmission oil;

instructions for determining a plurality of preliminary initial fan request signals, each request signal having a value based on at least one engine condition, wherein a transmission oil initial fan request signal is based on the transmission oil temperature and the threshold temperature; and instructions for determining the applied fan request signal as the initial fan request signal with the greatest value.

29. The medium of claim 28 wherein the transmission has an oil sump and wherein the instructions for monitoring the temperature of the transmission oil further comprise:

instructions for monitoring the temperature of the transmission oil at the transmission oil sump.

30. A computer readable storage medium having instructions stored thereon that are executable by a controller to perform a method of controlling an internal combustion engine in a vehicle having an air conditioning system, the engine including a variable speed fan and the air conditioning system including a condenser for transferring heat from a refrigerant during operation, the variable speed fan being driven in response to an applied fan request signal based on engine conditions and having a value between a maximum fan request value and a minimum fan request value, the engine being operable over an engine speed range between an idle speed and a full speed, the medium further comprising:

instructions for establishing a condenser threshold pressure;

instructions for monitoring a pressure in the condenser;

instructions for determining a plurality of preliminary initial fan request signals, each request signal having a value based on at least one engine condition, wherein a condenser initial fan request signal is based on the condenser pressure and the threshold pressure; and instructions for determining the applied fan request signal as the initial fan request signal with the greatest value.

* * * * *